US006741219B2

(12) United States Patent
Shor

(10) Patent No.: US 6,741,219 B2
(45) Date of Patent: May 25, 2004

(54) PARALLEL-FEED PLANAR HIGH-FREQUENCY ANTENNA

(75) Inventor: Arie Shor, Sunnyvale, CA (US)

(73) Assignee: Atheros Communications, Inc., Sunnyvale, CA (US)

( * ) Notice: Subject to any disclaimer, the term of this patent is extended or adjusted under 35 U.S.C. 154(b) by 0 days.

(21) Appl. No.: 10/140,336

(22) Filed: May 6, 2002

(65) Prior Publication Data

US 2003/0020665 A1 Jan. 30, 2003

Related U.S. Application Data

(60) Provisional application No. 60/307,750, filed on Jul. 25, 2001.

(51) Int. Cl.[7] ..... H01Q 9/28

(52) U.S. Cl. ..... 343/795; 343/700 MS; 343/821; 343/822

(58) Field of Search ..... 343/795, 700 MS, 343/820, 821, 822, 850, 851, 852, 853, 859, 860, 864

(56) References Cited

U.S. PATENT DOCUMENTS

| | | | | |
|---|---|---|---|---|
| 4,438,437 A | | 3/1984 | Burgmyer | 343/770 |
| 4,635,070 A | | 1/1987 | Hoover | 343/852 |
| 4,825,220 A | * | 4/1989 | Edward et al. | 343/795 |
| 5,293,175 A | * | 3/1994 | Hemmie et al. | 343/795 |
| 5,532,708 A | | 7/1996 | Krenz et al. | 343/795 |
| 5,708,446 A | | 1/1998 | Laramie | 343/815 |
| 5,754,145 A | | 5/1998 | Evans | 343/795 |
| 5,914,695 A | | 6/1999 | Liu et al. | 343/795 |
| 5,977,928 A | | 11/1999 | Ying et al. | 343/790 |
| 6,014,112 A | | 1/2000 | Koscica et al. | 343/795 |
| 6,037,911 A | | 3/2000 | Brankovic et al. | 343/795 |
| 6,175,338 B1 | * | 1/2001 | Quade | 343/795 |
| 6,198,443 B1 | | 3/2001 | Powles et al. | 343/702 |
| 6,204,826 B1 | | 3/2001 | Rutkowski et al. | 343/895 |
| 6,218,990 B1 | | 4/2001 | Grangeat et al. | 343/700 MS |
| 6,222,494 B1 | | 4/2001 | Erkocevic | 343/790 |
| 6,326,921 B1 | | 12/2001 | Egorov et al. | 343/700 MS |
| 6,337,666 B1 | | 1/2002 | Bishop | 343/795 |
| 6,337,667 B1 | | 1/2002 | Ayala et al. | 343/795 |
| 6,339,406 B1 | | 1/2002 | Nesic et al. | 343/797 |
| 6,377,227 B1 | | 4/2002 | Zhu et al. | 343/795 |

OTHER PUBLICATIONS

Copy of International Search Report dated Sep. 5, 2002 for PCT/US02/14479.

Copy of International Search Report dated Nov. 12, 2002 for PCT/US02/23678.

* cited by examiner

*Primary Examiner*—Hoang V. Nguyen

(74) *Attorney, Agent, or Firm*—John W. Carpenter; Reed Smith LLP

(57) ABSTRACT

The present invention provides a planar antenna having a scalable multi-dipole structure for receiving, and transmitting high-frequency signals, including a plurality of opposing layers of conducting strips disposed upon either side of an insulating (dielectric) substrate.

41 Claims, 3 Drawing Sheets

PARALLEL-FEED PLANAR HIGH-FREQUENCY ANTENNA

CROSS REFERENCE TO RELATED APPLICATIONS AND CLAIM OF PRIORITY

This invention claims priority to the following co-pending U.S. provisional patent application, which is incorporated herein by reference, in its entirety:

Shor, et al., Provisional Application Serial No. 60/307,750, entitled "PARALLEL-FEED PLANAR HIGH FREQUENCY ANTENNA," filed Jul. 25, 2001.

This present application is related to U.S. patent application Ser. No. 10/140,335, entitled "PLANAR HIGH-FREQUENCY ANTENNA", and Ser. No. 10/140,339, entitled "DUAL BAND PLANAR HIGH FREQUENCY ANTENNA", each filed on the same date as the present application, the disclosures of which are herein incorporated by reference in their entirety.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

BACKGROUND OF THE INVENTION

1. Field of the Invention

The present invention relates generally to the field of high frequency antennas and more particularly to the field of a parallel-feed, high-gain, planar, high-frequency antenna constructed using inexpensive manufacturing techniques.

2. Description of the Related Art

The wireless communication industry's foremost objective is to provide antennas having (1) the lowest possible manufacturing costs with consistently uniform performance, (2) high gain, and (3) high directivity.

Conventional dipole antennas, in which each element of half-wavelength radiators are fed in-phase, produce a substantially omni-directional radiation pattern in a plane normal to the axis of the radiators. However, providing such an omni-directional structure on a substantially planar and inexpensive surface, such as a printed circuit substrate, has proven a challenge. Existing attempts to achieve such planarity and performance rely on vias that penetrate the substrate to interconnect a plurality of conducting planes, thereby adding substantially to the cost of the antenna. Extending planar designs over a wide frequency range has proven even more difficult, since many designs only operate over a narrow frequency range.

In existing designs, as the frequency changes, the phase difference between the two dipoles changes, as result of the feed lines having different lengths. For example, U.S. Pat. No. 6,037,911 discloses a phase array antenna in which the a "different phase feeding is applied" by "changing the length of the feeding lines approaching the printed dipoles from outside of the printed patch to the phase center (middle of the antenna)."

Other designs require the construction of vias thru the substrate. U.S. Pat. No. 5,708,446 discloses an antenna that attempts to provide substantially omni-directional radiation pattern in a plane normal to the axis of the radiators. The patent discloses a corner reflector antenna array capable of being driven by a coaxial feed line. The antenna array comprises a right-angle corner reflector having first and second reflecting surfaces. A dielectric substrate is positioned adjacent the first reflective surface and contains a first and second opposing substrate surfaces and a plurality of dipole elements, each of the dipole elements including a first half dipole disposed on the first substrate surface and a second half dipole disposed on the second substrate surface. A twin line interconnection network, disposed on both the first and second substrate surfaces, provides a signal to the plurality of dipole elements. A printed circuit balun is used to connect the center and outer conductors of a coaxial feed line to the segments of the interconnection network disposed on the first and second substrate surfaces, respectively.

However, in order to connect the coaxial cable to the interconnection network, U.S. Pat. No. 5,708,446 requires a via to be constructed through the substrate. This via's penetration through the substrate requires additional manufacturing steps and, thus, adds substantially to the cost of the antenna.

Furthermore, other attempts require branched feed structures that further increase the number of manufacturing steps and thereby increase the cost of the antenna. A need exists to use fewer parts to assemble the feed so as to reduce labor costs. Present manufacturing processes rely on human skill in the assembly of the feed components. Hence, human error enters the assembly process and quality control must be used to ferret out and minimize such human error. This adds to the cost of the feed. Such human assembled feeds are also inconsistent in performance.

For example, U.S. Pat. No. 6,037,911 discloses a phase array antenna comprising a dielectric substrate, a plurality of dipole means each comprising a first and a second element, said first elements being printed on said front face and pointing in a first direction and said second elements being printed on said back face, and a metal strip means comprising a first line printed on said front face and coupled to said first element and a second line printed on said back face and coupled to said second element. A reflector means is also spaced to and parallel with said back face of said dielectric substrate and a low loss material is located between said reflector means and said back face, whereby said first and second lines respectively comprise a plurality of first and second line portions and said first and second line portions respectively being connected to each other by T-junctions.

However, in order to provide a balanced, omni-directional performance, U.S. Pat. No. 6,037,911 requires a branched feed structure through the utilization of T-junctions. These T-junctions add complexity to the design and, again, increase the cost of the antenna.

Finally, more complex, high frequency antennas have a high loss line structure and, thus, require an expensive dielectric substrate. Due to the simplicity of production and elements and the low cost of the raw materials, the antenna's cost is significantly lower than for more complicated, high frequency antennas.

SUMMARY OF THE INVENTION

To address the shortcomings of the available art, the present invention provides a planar antenna having a scalable multi-dipole structure for receiving, and transmitting high-frequency signals, including a plurality of opposing layers of conducting strips and antenna elements disposed upon either side of an insulating (dielectric) substrate.

In one embodiment, the invention consists of 4 dipoles in a planar configuration. Two dipoles are in a same horizontal level and symmetric on opposite sides of a feedline. This orientation enables achievement of omni-direction coverage of signals radiated from the antenna. An identical pair of dipoles are stacked on top (or below) the original pair. A balanced feedline passes up to a point which is symmetric to all 4 dipole dipoles and splits to 4 balanced feed lines that feed each of the dipoles in-phase.

In another embodiment, the present invention is an antenna that optimized to function between 5.15 and 5.35 GHz frequency range.

Another embodiment of the present invention incorporates two series capacitors coupled to each respective feed structures to help in matching.

BRIEF DESCRIPTION OF THE DRAWINGS

The present invention will be readily understood by the following detailed description in conjunction with the accompanying drawings, wherein like reference numerals designate like structural elements, and in which.

DETAILED DESCRIPTION OF THE INVENTION

The following description is provided to enable any person skilled in the art to make and use the invention and sets forth the best modes contemplated by the inventor for carrying out the invention. Various modifications, however, will remain readily apparent to those skilled in the art. Any and all such modifications, equivalents and alternatives are intended to fall within the spirit and scope of the present invention.

Figure 1:
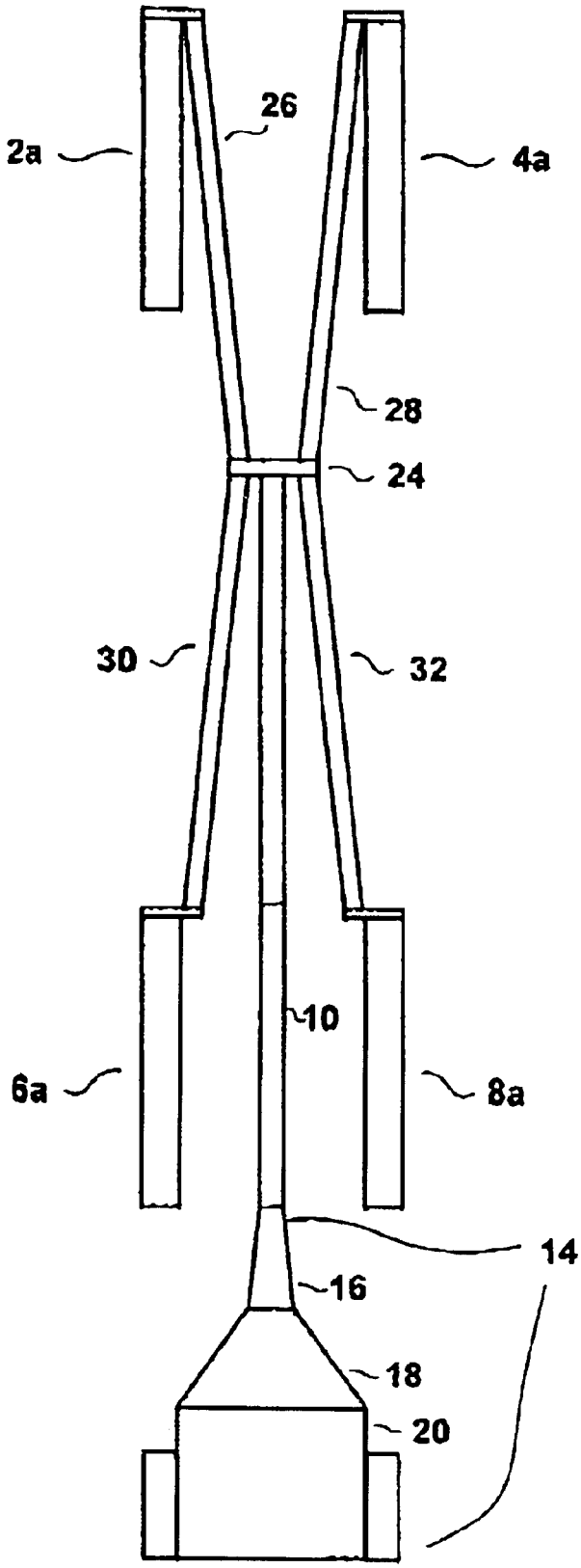
FIG. 1 illustrates a view of a first side (A) of one embodiment of the present invention having parallel feed structures each feeding 4 dipole halves.

As shown in FIG. 1., there is illustrated a first side of a planar antenna 1 having a scalable half-wavelength multi-dipole structure for receiving and transmitting high-frequency signals. The antenna 1 includes two layers of conducting (preferably metallic) strips disposed upon opposing sides of an insulating substrate (not shown), that serves as a dielectric layer. A plurality of half-wavelength dipole elements 2*a*, 4*a*, 6*a*, 8*a* are fed "in parallel," i.e. a feed structure 10 feeds a common feed point 24. The dipole elements are connected by equal length feed lines 26, 28, 30, 32 to the common feed point 24.

Figure 2:
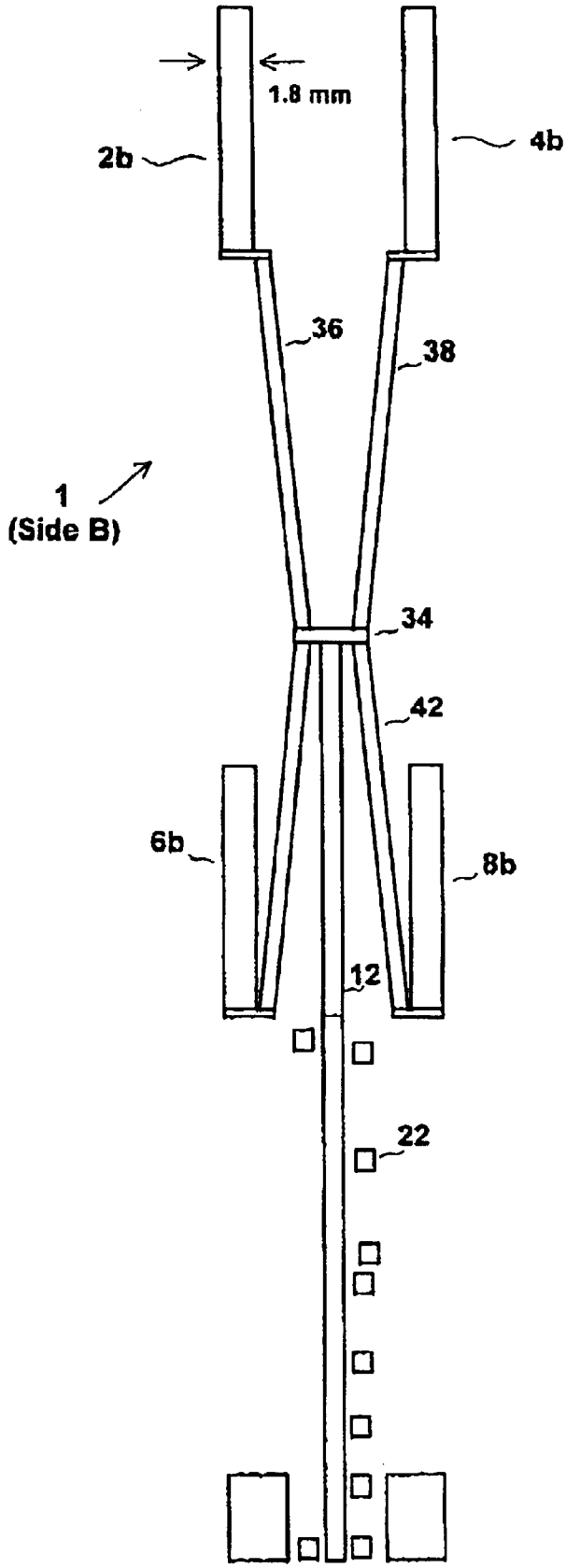
FIG. 2 illustrates a view of a second side (B) of one embodiment of the present invention having parallel feed structures each feeding 4 dipole halves.

The reverse side of the planar antenna is illustrated in FIG. 2. A plurality of half-wavelength dipoles 2*b*, 4*b*, 6*b*, 8*b* are similarly fed "in parallel" with a feed structure 12, which feeds a common feed point 34. The dipoles are connected by equal length feed lines 36, 38, 40, 42.

To ensure balanced, omni-directional performance, the dipoles are symmetrically positioned around the feed structures 10, 12. A balun structure 14, including tapered portions 16 and 18 are lower portion 20, provides the balanced performance characteristics required of feed structures. The feed structures 10, 12 are preferably connected to two conductors in a coaxial configuration (not shown). In the illustrated example, the feed structure 10, including the balun structure 14, is connected to an outer grounded conductor, while the other feed structure 12 is connected to an inner conductor. The contract points 22 on the second side are provided for testing and for I/O impedance matching, as required.

Figure 3:
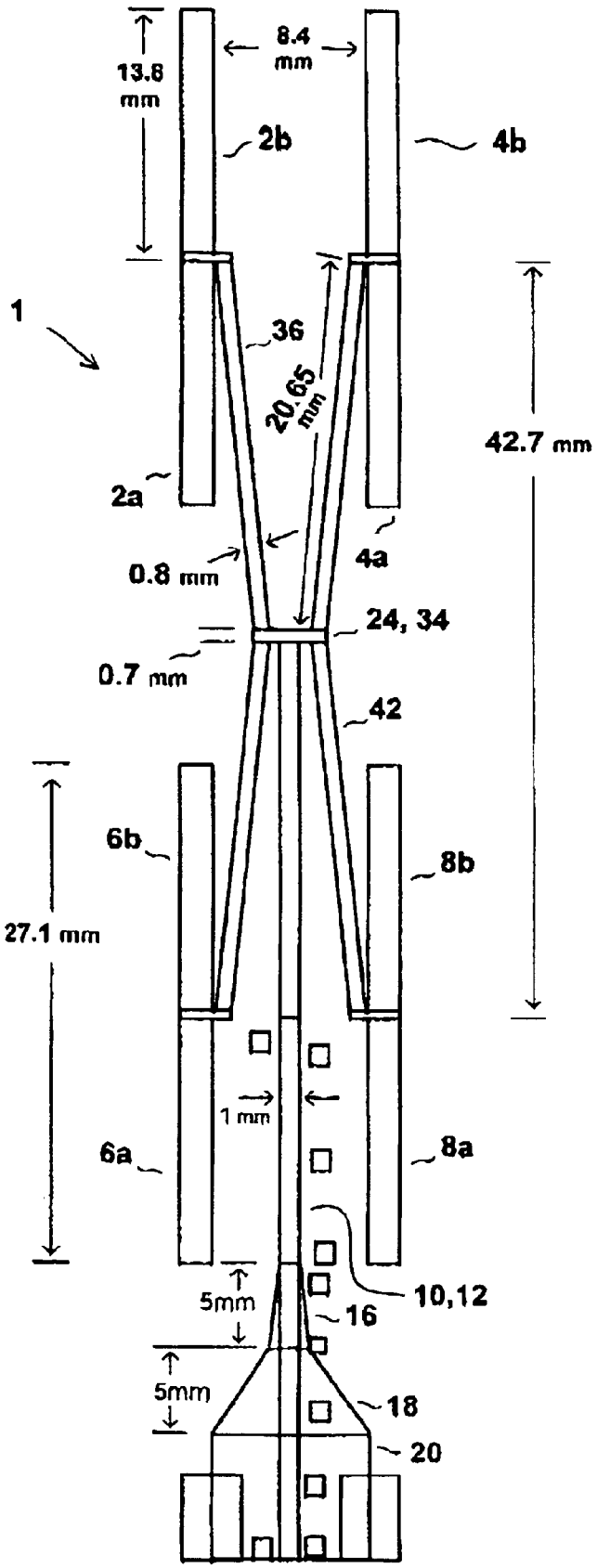
FIG. 3 illustrates a combined view (Side A and Side B) of the structure of FIGS. 1 and 2, without the substrate, including dimensions of an embodiment for application to the frequency range of 5.15 to 5.85 GHz.

The structures of FIGS. 1 and 2 are arranged symmetrically (horizontally and vertically) on the opposite sides of the substrate as shown in FIG. 3. FIG. 3 is a combined view of the antenna structure, shown without the substrate (for clarity). In this view, it is clear that the common feed points 24, 34 are symmetrically aligned, and that the dipole elements do not overlap (i.e. element 2*a* is below element 2*b*).

As described herein, the present invention can operate over a wider frequency range than other designs. In order to get gain enhancement, the 4 dipoles are fed in-phase (0 degrees or 360 degree multiples). In other designs, as the frequency changes, the phase difference between the two dipoles changes, as a result of the feed structures having different lengths. In the present invention, however, since all the dipoles are fed with an equal length feed line, even as the frequency changes, the dipoles are still fed with the same relative phase. This results in a operating range of approximately +/−6% of the nominal center frequency of the antenna, whereas previous designs were generally limited to operation over a range +/−2% of the nominal center frequency.

The Federal Communications Commission (FCC) allocates a certain number of frequency bands where a license is not required for use. For example, many garage-door openers operate in the unlicensed 49-MHz band. Similarly, the unlicensed 2.4-GHz frequency band has become popular for connecting computers to a wireless LAN.

Unfortunately, the 2.4-GHz band hosts a myriad of devices and competing standards that have led to increasing interference and degraded performance in the wireless networking world. Devices operating at 2.4-GHz include common household items such as microwave ovens, cordless phones and wireless security cameras-not to mention computing devices that are networked wirelessly. To add to the confusion, the industry has deployed multiple 2.4-GHz standards for wireless networking. The IEEE 802.11b standard is most commonly used for enterprise wireless LANs; the Home RF standard exists for wireless LANs in the home; and Bluetooth has been developed as a short-distance wireless cable replacement standard for personal area networks (PANs).

The interference and performance issues at 2.4-GHz have the wireless LAN industry headed for the open 5.15 to 5.35 GHz frequency band, where the opportunity exists for a much cleaner wireless networking environment. The 5-GHz band is void of interference from microwaves and has more than twice the available bandwidth of 2.4-GHz, thereby allowing for higher data throughput and multimedia application support. The open 5-GHz spectrum provides an opportunity for the potential creation of a unified wireless protocol that will support a broad range of devices and applications. Everything from cordless phones to high-definition televisions and personal computers can communicate on the same multipurpose network under a single unified protocol. As a result, the antenna operating between the 5.15 and 5.35 GHz frequency band would encourage the creation and support of a wide range of low and high data rate devices that could all communicate on a single wireless network.

Furthermore, the antenna's higher 5 GHz data rate provides for longer battery life. This is due to the fact that it takes less time to transmit the same amount of data at 5 GHz than at a lower frequency. For example, when sending 1 Mbyte of data, a system with antenna operating in the 5 GHz range uses 4 to 9 times less energy than another system operating in the 2 GHz range. Also, the antenna's lack of vias and inclusion of balanced, independent feed structures significantly reduces system design time, manufacturing costs and board real estate. Preferably, cost is further minimized through the use of standard-process Digital CMOS-the technology used for manufacturing 95% of all chips today The dimensions in FIG. 3 provide for an antenna optimized for a transceiver operating between 5.15 to 5.85 GHz. The balun structures 16 and 18 are each 5 mm high, while the feed structures 10, 12 are both 1 mm wide. The equal length feed lines 26, 28, 30, 32, 36, 38, 40 and 42 are 0.8 mm wide and 20.65 mm long. Each dipole element 2*a*, 2*b*, 4*a*, 4*b*, 6*a*, 6*b*, 8*a*, 8*b* is 1.8 mm wide and 13.8 mm long. The common feed points 24, 34 are 0.7 mm wide. The dipole elements are spaced 8.4 mm apart on each side. The distance between the ends of the feed lines (vertically) is 42.7 mm.

Additionally, because the antenna 1 provides low loss line structure, it is possible to use for the substrate (not shown) a dielectric of a standard quality, and thus of low cost, without considerably reducing the efficiency of the antenna. The substrate (not shown) is preferably between approximately 100 and 700 micrometers thick to provide sufficient rigidity to support the antenna structure. Because of the simplicity of production and elements and the low cost of the raw materials, the cost of the antenna is considerably lower than for more complicated high frequency antennas.

In one embodiment of the present invention, two series capacitors (one on top of the other) are added to the feed structures 10, 12. The values of the capacitors are in the range of 0.5–1.0 pF, and their location is selected to help in matching. For example, the first capacitor is placed in series with the first feed structure 10 at a point 7 mm below the common feed point 24. The second capacitor is placed in a similar position on the second feed structure, in series with second feed structure 12, at a point 7 mm below the common feed point 34. The capacitor as optional, and, if used, different cap values and placement can be made based on implementation details (amount of matching required, etc.).

Those skilled in the art will appreciate that various adaptations and modifications of the just-described preferred embodiments can be configured differently than as described without departing from the scope and spirit of the invention. For example, it is clear that the invention is not limited to operation in the 5 GHz frequency band, but may be adapted to operate with other high frequency signals. Therefore, it is to be understood that, within the scope of the appended claims, the invention may be practiced other than as specifically described herein.

What is claimed and desired to be secured by Letters Patent of the United States is:

1. An antenna, comprising:

a substrate;

a first feed structure disposed on a first side of the substrate;

a second feed structure disposed on a second side of the substrate; and a plurality of dipole elements disposed on opposite sides of the substrate;

wherein the dipole elements are each fed in parallel from one of the first and second feed structure.

2. The antenna according to claim 1, wherein the first and second feed structures are not connected to each other.

3. The antenna according to claim 2, further comprising:

a first set of equal length feed lines disposed on the first side of the substrate; and a second set of equal length feed lines disposed on the second side of the substrate;

wherein:

each feed line of the first set of feed lines is coupled to a feed point of the first feed structure and one of the plurality of dipole elements disposed on the first side of the substrate; and each feed line of the second set of feed lines is coupled to a feed point of the second feed structure and one of the plurality of dipole elements disposed on the second side of the substrate.

4. The antenna according to claim 3, wherein each dipole element is symmetrically arranged with another dipole element on the same side of the substrate about a centerline axis defined by the first and second feed structures.

5. The antenna according to claim 4, wherein each dipole element is symmetrically arranged with another dipole element on an opposite side of the substrate about an axis between the symmetrically arranged opposite sided dipole elements.

6. The antenna according to claim 5 wherein each pair of symmetrically arranged opposite sided dipole elements comprises a bifurcated dipole fed at a midpoint of the bifurcated dipole by the feed lines.

7. The antenna according to claim 5, wherein each dipole element is symmetrically arranged about a centerline axis between the first and second feed structures with another dipole element on an opposite side of the substrate.

8. The antenna according to claim 3, wherein each dipole element is symmetrically arranged with another dipole element on an opposite side of the substrate.

9. The antenna according to claim 3, wherein:

the feed point of the first feed structure comprises a first horizontal feed bar having a midpoint and two ends, the midpoint of the first horizontal feed bar connected to an end of the first feed structure, and each end of the first horizontal feed bar connected to one of the feed lines disposed on the first side of the substrate; and the feed point of the second feed structure comprises a second horizontal feed bar having a midpoint and two ends, the midpoint of the second horizontal feed bar connected to an end of the second feed structure, and each end of the second horizontal feed bar connected to one of the feed lines disposed on the second of the substrate.

10. The antenna according to claim 9, wherein each feed bar is attached at an end of the feed structure to which it is connected.

11. The antenna according to claim 10, wherein each feed bar is perpendicular to an axis of the feed structure to which it is connected.

12. The antenna according to claim 3, further comprising a balun attached to the first feed structure.

13. The antenna according to claim 12, wherein said balun comprises at least one tapered section.

14. The antenna according to claim 3, further comprising a set of test points attached to one of the first and second feed structures.

15. The antenna according to claim 1, wherein the dipole elements on a first side of the substrate are fed in parallel from the first feed structure via feed lines emanating from the feed structure in an x-shaped pattern.

16. The antenna according to claim 15, further comprising:

a first feed point connecting the first feed structure and the x-shape patterned feed lines;

wherein an intersection of the x-shape patterned feed lines is offset by a width of the feed point.

17. An antenna, comprising:

a substrate;

a first feed structure disposed on a first side of the substrate;

a second feed structure, independent of the first feed structure, disposed on a second side of the substrate;

a first feed point disposed on the first side of the substrate and coupled to the first feed structure;

a second feed point disposed on the second side of the substrate and coupled to the second feed structure, a plurality of feed lines, wherein at least one feed line is disposed on a first side of substrate and coupled to the first feed point, and at least one feed line is disposed on a second side of substrate and is coupled to the second feed point; and a plurality of bifurcated dipoles, wherein a first part of each bifurcated dipole is disposed on the first side of the substrate and coupled to at least one feed line, and a second part of each bifurcated dipole is disposed on the second side of the substrate and coupled to at least one feed line;

wherein each of the bifurcated dipoles is fed in parallel with at least one other of the bifurcated dipoles.

18. A wireless communication device having an antenna for receiving and transmitting high-frequency signals, comprising:

a substrate;

at least two dipoles disposed on opposite sides of the substrate;

wherein:

each dipole is bifurcated between the opposing sides of the substrate;

each dipole is fed in parallel with at least one other dipole;

the dipole coupled to a feed point; and the feed point coupled to a feed structure.

19. The wireless communication device according to claim 18, further comprising a plurality of dipoles symmetrically arranged on opposite sides of the substrate.

20. An antenna, comprising:

a substrate;

a first feed structure disposed on a first side of the substrate;

a second feed structure disposed on a second side of the substrate;

a plurality of dipole elements disposed on opposite sides of the substrate;

a first set of equal length feed lines disposed on the first side of the substrate; and a second set of equal length feed lines disposed on the second side of the substrate;

a balun attached to the first feed structure; and a set of test points attached to one of the first and second feed structures; wherein:

the plurality of dipole elements are fed in parallel from one of the first and second feed structures;

the first and second feed structures are not connected to each other;

each feed line of the first set of feed lines is coupled to a feed point of the first feed structure and one of the plurality of dipole elements disposed on the first side of the substrate;

each feed line of the second set of feed lines is coupled to a feed point of the second feed structure and one of the plurality of dipole elements disposed on the second side of the substrate;

each dipole element is symmetrically arranged with another dipole element on the same side of the substrate about a centerline axis defined by the first and second feed structures;

each dipole element is symmetrically arranged with another dipole element on an opposite side of the substrate about an axis between the symmetrically arranged opposite sided dipole elements;

each pair of symmetrically arranged opposite sided dipole elements comprise a bifurcated diole fed at a midooint of the bifurcated dipole by the feed lines;

the feed point of the first feed structure comprises a first horizonal feed bar having a midpoint and two ends, the midpoint of the first horizontal feed bar connected to an end of the first feed structure, and each end of the first horizontal feed bar connected to one of the feed lines disposed on the first side of the substrate; and the feed point of the second feed structure comprises a second horizontal feed bar having a midpoint and two ends, the midpoint of the second horizontal feed bar connected to an end of the second feed structure, and each end of the second horizontal feed bar connected to one of the feed lines disposed on the second side of the substrate; and the feed point of the secons feed structure comprises a second horizontal feed bar having a midpoint and two ends, the midpoint of the second horiaontal feed bar connected to an end of the second feed structure, and each end of the second horizontal feed bar connected to one of the feed lines disposed on the second side of the substrate; and said balun comprise at least one tapered section.

21. An antenna, comprising:

a substrate;

a first feed structure disposed on a first side of the substrate;

a second feed structure, independent of the first feed structure, disposed on a second side of the substrate;

a first feed point disposed on the first side of the substrate and coupled to the first feed structure;

a second feed point disposed on the second side of the substrate and coupled to the second feed structure, a plurality of feed lines, wherein at least one feed line is disposed on a first side of substrate and coupled to the first feed point, and at least one feed line is disposed on a second side of substrate and is coupled to the second feed point; and a plurality of bifurcated dipoles, wherein a first part of each bifurcated dipole is disposed on the first side of the substrate and coupled to at least one the feed line, and a second part of each bifurcated dipole is disposed on the second side of the substrate and coupled to at least one the feed line;

wherein:

the first and second feed points are symmetrically aligned on opposite sides of the substrate;

and the bifurcated dipoles are disposed symmetrically about a first line of symmetry oriented along a vertical centerline of the first and second feed structures.

22. The antenna according to claim 21, wherein each dipole is bifurcated along a horizontal axis that intersects a midpoint of each dipole.

23. The antenna according to claim 21, wherein each feed line is of equal length.

24. The antenna according to claim 21, wherein the bifurcated dipoles are coupled in series along the first and second feed structures.

25. An antenna according to claim 24, wherein the bifurcated dipoles are disposed at equidistant locations along the first and second feed structures.

26. The antenna according to claim 21, wherein:

the substrate has a thickness between approximately 100 and 700 micrometers;

the first and second feed structures are 1 millimeter wide;

each feed line is approximately 0.8 millimeters wide and approximately 20.65 millimeters long;

each dipole part is approximately 1.8 millimeters wide and approximately 13.8 millimeters long; the feed points are approximately 0.7 millimeters wide; the dipoles are horizontally separated by a distance of approximately 8.4 millimeters;

and the dipoles are vertically separated by a distance of approximately 42.7 millimeters.

27. The antenna of claim 26, wherein the antenna operates in frequency range between 5.15 and 5.35 GHz.

28. The antenna according claim 21, wherein the antenna provides a substantially omni-directional gain pattern.

29. The antenna according claim 21, wherein the first and second feed structures are balanced.

30. The antenna according to claim 21, wherein the substrate is a substantially planar dielectric.

31. The antenna according to claim 21, wherein the substrate does not contain vias.

32. The antenna according to claim 21, further comprising a balun coupled to one of the feed structures.

33. The antenna according to claim 32, wherein the balun comprises a lower portion and a tapered portion.

34. The antenna according to claim 32, further comprising a output connector coupled to the balun.

35. The antenna according to claim 34, wherein the output connector is a coaxial cable.

36. The antenna according to claim 34, wherein:

the output connector is a grounded conductor connected to the balun;

and the output connector further comprising a second conductor connected to one of the feed structures.

37. The antenna according to claim 34, wherein the output connector is connected to an output device.

38. The antenna according to claim 37, wherein the output device is a RF device.

39. The antenna according to claim 21, wherein at least one testing strip is connected to one of the feed structures.

40. The antenna according to claim 39, wherein the testing strip is metallic.

41. The antenna according to claim 39, further comprising contact points connected to at least one testing strip.

* * * * *